United States Patent [19]

Kvistad

[11] Patent Number: 4,669,353

[45] Date of Patent: Jun. 2, 1987

[54] MUSICAL PERCUSSION INSTRUMENT

[76] Inventor: Garry M. Kvistad, Box 381A, R.D. 1, West Hurley, N.Y. 12491

[21] Appl. No.: 895,435

[22] Filed: Aug. 11, 1986

[51] Int. Cl.[4] ..... G10D 13/08

[52] U.S. Cl. ..... 84/403; 446/418

[58] Field of Search ..... 84/402–410; 446/418

[56] References Cited

U.S. PATENT DOCUMENTS 4,149,444 4/1979 Parsons ..... 84/404

FOREIGN PATENT DOCUMENTS 6510500 2/1967 Netherlands ..... 84/403

*Primary Examiner*—Lawrence R. Franklin

*Attorney, Agent, or Firm*—Charles J. Brown

[57] ABSTRACT

A musical percussion instrument wherein percussion element are removably held by force-fit within nominally undersized holes in side-rails of substantially rigid but readily elastically deformable material to form a unitary assembly without further means of interconnection.

6 Claims, 3 Drawing Figures

MUSICAL PERCUSSION INSTRUMENT

BACKGROUND OF THE INVENTION

Percussion element instruments, as that expression is used herein, are any of various forms of musical instruments wherein a series of tubes, bars, plates or the like are arranged side-by-side usually in the order of the musical scale, to emit sound when struck. Such instruments, sometimes generically called ideophones, are specifically xylophones, metalaphones, tubaphones or other designations depending upon the configuration and material of the percussion elements. The term "percussion elements" is intended herein to mean collectively any and all such ideophone elements regardless of material or shape.

Common to most conventional percussion element instruments of this sort is a pair of side-rails which support the opposite ends of the elements usually at their nodal points. Side-rails are most often straight, co-planar and coextensive, and typically are spaced apart more widely at one end than the other so that the percussion elements of different lengths arranged between them can be in the sequence of a musical scale.

Prior art means for holding the percussion elements in side-rails take many forms, most often including oversized holes through which the end portions of the elements project with some form of element-encircling means such as string connecting them to the side-rails to hold them in place. Rubber cradles mounted on the side-rails have also been employed as in U.S. Pat. No. 4,543,871. The prior art also includes a commercial form of toy chimes wherein the side-rails are of substantially rigid plastic foam with aligned pairs of holes which are measurably larger than the percussion elements. The elements and side-rails are loosely fitted together and this design lacks any means for holding the elements in their proper position in a unitary assembly with the side-rails.

It is a principal object of the present invention to provide a simple form of percussion element and side-rail assembly, especially but not necessarily applicable to children's toy instruments, wherein the bars are removably held by force-fit in elastically deformable holes in the side-rails without further means of interconnection.

SUMMARY OF THE INVENTION

The musical percussion instrument of the invention comprises two spaced co-planar elongated side-rails of a material which is substantially rigid but readily elastically deformable. A plurality of aligned pairs of transverse holes are defined in the respective side-rails each having a certain nominal minimum dimension. A corresponding plurality of percussion elements are provided each having a width greater than the nominal minimum dimension of the transverse holes. Each percussion element has end portions extending through an aligned pair of the holes and held firmly but removably by elastic deformation of the side-rails. By this construction the side-rails and percussion elements are resiliently interconnected in a unitary assembly without further means of interconnection.

In a preferred form of the invention the side-rails are of substantially rigid deformable plastic foam and the elements and transverse holes are of circular cross section, the elements having a greater diameter than the holes.

It is a simple matter for a user, even a young child, to connect the side-rails and elements together by forcing the element end portions into the transverse holes. The nodal points of the bars can be marked and the bars themselves can be color coded to aid in this process of assembly.

DESCRIPTION OF PREFERRED EMBODIMENT

Figure 1:
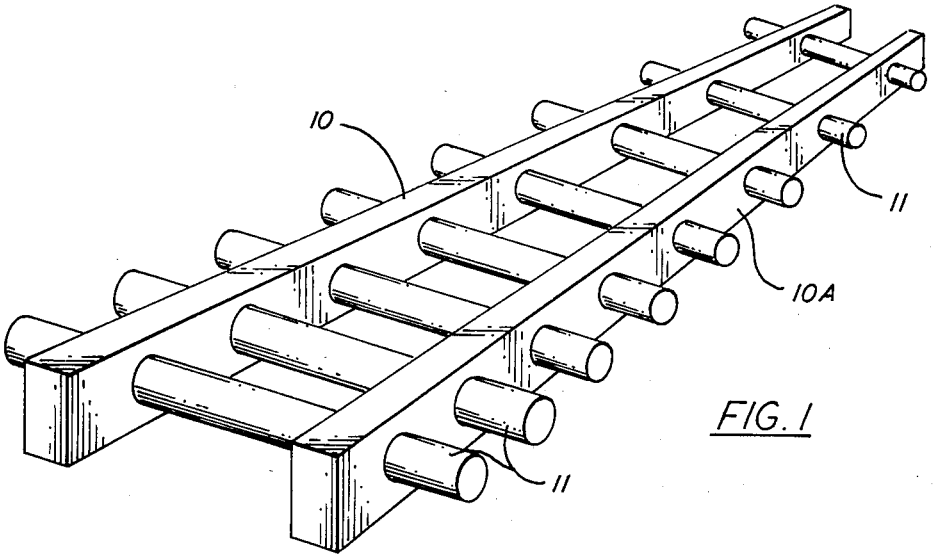
FIG. 1 is a perspective view of one form of the musical percussion instrument of the invention.

Referring first to FIG. 1, the assembly of the invention comprises quite simply a pair of side-rails 10 and 10A and a plurality, usually eight, of percussion elements 11. The percussion elements or ideophones, may be in the form of bars, tubes, plates, or many other configurations. They may be dowels of wood or other non-metallic material, or they may be of metal. In one preferred embodiment of the percussion elements 11 are aluminum tubes seven-eighths inch in diameter with a wall thickness of 0.049 inch. To produce the successive notes of the musical scale, the longest of such tubes is approximately fourteen inches and the shortest approximately ten inches. For purposes of a children's toy the musical instrument of the invention could very well embody color coding so that the longest percussion element producing the lowest note could be red and the shortest percussion element producing the highest note could be violet, with all of the colors of the chromatic scale in proper sequence in between.

The nodal points of each of the elements 11 should be marked, which for configurations such as those described above are 22.4% of the total length inwardly from each extremity. As is well known the nodal point is that place on the elongated element where there is little or no vibration when the element is struck and emits sound. In accordance with conventional practice the side-rails 10 and 10A engaging the nodal points of the respective bars diverge outwardly from a relatively close spacing where they hold the shortest percussion element to a relatively wide spacing where they hold the longest percussion element.

Figure 2:
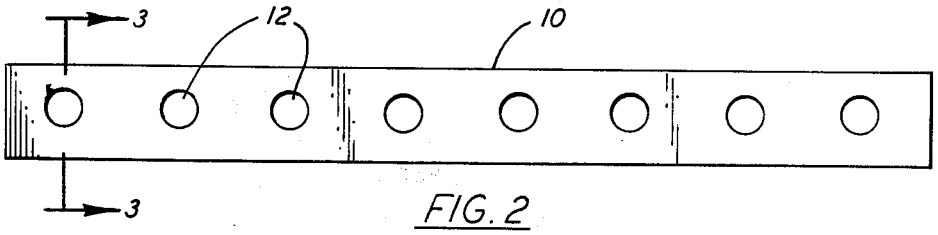
FIG. 2 is a side elevation of one side-rail viewed at a right angle, with no allowance for the small angle from the perpendicular of the element end portions relative to the side-rail.
Figure 3:
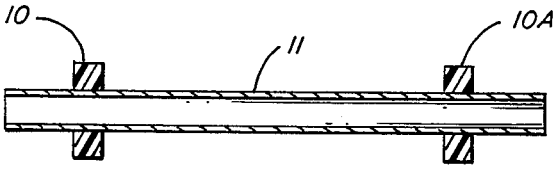
FIG. 3 is a lateral section taken along the line 3—3 of FIG. 2.

One of the side-rails is shown in elevation in FIG. 2, and the other side-rail is exactly of the same configuration. Each defines a series of equally spaced transverse circular holes 12 having a given nominal diameter slightly less than the diameter of the percussion elements 11. In the embodiment described above the holes 12 should have a nominal diameter approximately one-sixteenth inch less than the diameter of the percussion elements 11. The side-rails 10 and 10A are co-planar with their ends co-extensive and therefore their holes are in aligned pairs for properly receiving the respective percussion elements 11. The side-rails 10 and 10A may be of rectangular cross section, perhaps one-half inch wide on one side and two inches wide on the other side. The holes 12 extend through the broad side of the side-rails. The corners of the side-rails may be rounded.

Perhaps the most important factor in the choice of material for the side-rails 10 and 10A is that it must be substantially rigid but also readily elastically deformable so that the respective percussion elements 11 may easily be pushed through the relatively undersized holes 12. The material also should be chosen for an appropriate affect on the quality of the sound produced by the percussion elements 11. Solid cellular foam material such as high-density, very firm polyether is particularly advantageous for this purpose because it is sufficiently elastically deformable so that the elements 11 may be repeatedly thrust into and removed from the undersized holes and still be gripped firmly. This grip should be such that the elements 11 will not inadvertently slide out of the holes 12 in the side-rails 10; the parts together should form a unitary assembly but at the same time be easily disassembled. The material for the side-rails 10 and 10A should also be chosen for optimum vibration absorption so that when struck the percussion elements 11 transmit only a minimum of vibration through the side-rails to whatever surface supports them.

As an educational toy the assembly of the invention is instructive on how pitch varies with the lengths of the percussion elements, why sound is at its highest quality when the percussion elements are held at their nodal points, how the musical and chromatic scales are interrelated, and similar physical principles. As an aid to beginners the successive percussion elements may not only be color coded but also numbered, and sheet music with corresponding colored and numbered notes may be provided.

What is claimed is:

1. A musical percussion instrument comprising (a) two spaced co-planar elongated side-rails of a material which is substantially rigid but readily elastically deformable, (b) a plurality of aligned pairs of transverse holes in the respective side-rails each having a certain nominal minimum dimension, (c) a corresponding plurality of percussion elements each having a width greater than the nominal minumum dimension of the transverse holes, (d) each percussion element having end portions extending through an aligned pair of said holes and held firmly but removably by elastic deformation of the side-rails, (e) whereby the side-rails and percussion elements are resiliently interconnected in a unitary assembly without further means of interconnection.

2. A percussion instrument according to claim 1 wherein the side-rails are of substantially rigid deformable plastic foam.

3. A percussion instrument according to claim 1 wherein the holes and percussion elements are of circular cross section and the elements have a greater diameter than the nominal diameter of the holes before the elements are inserted into the holes.

4. A percussion instrument according to claim 1 wherein the side-rails grip the elements substantially at the nodal points of the elements.

5. A percussion instrument according to claim 1 wherein the side-rails are of rectangular cross section and the holes extend between the broader faces thereof.

6. A musical percussion instrument comprising (a) two spaced substantially co-planar and coextensive straight elongated side-rails of substantially rigid but readily elastically deformable plastic foam and of substantially rectangular cross section, (b) a plurality of aligned pairs of circular transverse holes of the same nominal diameter extending through the respective side-rails between the broader faces thereof, (c) a corresponding plurality of percussion elements of circular cross section having an equal diameter greater than the nominal diameter of the transverse holes, (d) each percussion element having end portions extending through an aligned pair of said holes and held firmly but removably by elastic deformation of the plastic foam material, (e) whereby the side-rails and percussion elements are resiliently interconnected in a unitary assembly without further means of interconnection.

* * * * *